United States Patent [19]

Gulino

[11] Patent Number: 4,797,963

[45] Date of Patent: Jan. 17, 1989

[54] CARPET FINISHING TOOL

[76] Inventor: Roy Gulino, 505 E. County Line Rd., Lakewood, N.J. 08701

[21] Appl. No.: 182,096

[22] Filed: Apr. 15, 1988

[51] Int. Cl.[4] ..... B25F 1/00

[52] U.S. Cl. ..... 7/103; 81/488; 254/200

[58] Field of Search ..... 81/488; 7/103; 254/200, 254/203; 29/243.5, 235; D8/15

[56] References Cited

U.S. PATENT DOCUMENTS 3,538,523 11/1970 Sparks ..... 7/158

3,546,726 12/1970 Bizzigotti ..... 7/158

3,617,082 11/1971 Sparks ..... 30/307

4,750,226 6/1988 Costill ..... 81/488

*Primary Examiner*—Roscoe V. Parker

*Attorney, Agent, or Firm*—Clifford G. Frayne

[57] ABSTRACT

A carpet finishing tool having a handle supporting a longitudinal shaft, the shaft being angularly cut proximate to its end to permit the mounting of a biased rotatable disk having a truncated conical outer surface and rounded edges, the edges contacting the carpet for securing the carpet when the carpet is secured in a tacked mode, the truncated conical outer surface contacting the carpet and securing the carpet when the carpet is secured in an adhesive mode.

6 Claims, 1 Drawing Sheet

CARPET FINISHING TOOL

FIELD OF INVENTION

The invention relates to a carpet finishing tool and, in particular, to a hand-held tool which can be manipulated for tucking carpet to a baseboard, which carpet is either tacked to the floor or held to the floor by adhesive.

BACKGROUND OF THE INVENTION

Wall-to-wall carpeting is normally installed in one of two manners. The first manner is where is a strip of wood is positioned parallel to the baseboard along the wall, the strip of wood having depending upwardly therefrom, a series of tacks. A gap exists between this strip of wood and the baseboard so that the edge of the carpet may be tucked into this gap thereby providing an aesthetic appearance. The installer normally cuts the carpet, secures the carpet to the strip of wood containing the upwardly depending tacks and then attempts to tuck the remaining portion of the carpet into the gap between the strip of wood and the baseboard. The tacks on the strip of wood secure the carpet and prevent wrinkling.

The second means of installation is where the carpet is secured directly to the floor by adhesive. This is normally done when the underlying floor is cement or aggregate. In this configuration, no anchor strip containing tacks is utilized but, rather, the adhesive is applied on the floor right up to the baseboard and the carpet is stretched and placed on the adhesive. In order to provide for an aesthetic appearance, the edge of the carpet proximate to the baseboard must be compressed onto the adhesive to ensure that the edge will not curl over.

In the past, installers have utilized a variety of makeshift equipment to tuck such carpets where padding and strips containing tacks are utilized and with respect to adhesive carpet, have utilized the tool which would permit them to exert pressure proximate to the baseboard to ensure that the edge of the carpet is adhesed. Additionally, certain tools have been developed which are the subject of patents, which tools tend to provide the installer with the equipment necessary to complete this task. See U.S. Pat. Nos. 3,538,523, 3,546,726 and 3,617,082. However, none of the aforementioned patents provide the simplistic approach to Applicant's invention and provide a tool which can be operated with one hand and which is not cumbersome and can be carried by the installer in his belt.

OBJECTS OF THE INVENTION

An object of the present invention is to provide a novel carpet finishing tool adaptable for aesthetically securing the edges of carpet which may be either tacked or secured to the floor by adhesive.

A further object of the present invention is to provide a novel carpet finishing tool having few moving parts and operable with one hand.

A still further object of the present invention is to provide a novel carpet finishing tool which the operator can utilize in an efficient manner over large lengths of carpet.

SUMMARY OF THE INVENTION

The present invention relates to a new and improved carpet tucker which is operable by one hand, and permits the installer to ensure that the edge of the carpet is tucked securely and evenly with the baseboard regardless of whether the carpet is secured by tacking strips or adhesive. The device comprises a handle having a longitudinal shaft protruding therefrom, said shaft being cut at an angle proximate to its end to permit the mounting of a biased rotatable disk being a truncated cone on its outer surface, the truncated surface designed for contacting the carpet when the carpet is installed with adhesive so that as the tool is drawn along the baseboard, this surface presses the edge of the carpet and the adhesive together to secure the carpet, this edge of the tool being designed to be aligned in a vertical position parallel with the baseboard when the tool is drawn along the edge of the baseboard such that the edge of the disk tucks the carpet in the gap between the baseboard and the tacked strip.

BRIEF DESCRIPTION OF THE DRAWINGS

A better understanding of the invention hereof, together with other objects and advantages will become evident upon consideration of the detailed disclosure thereof especially when considered in light of the accompanying drawings wherein.

DETAILED DESCRIPTION OF THE DRAWINGS

Figure 1:
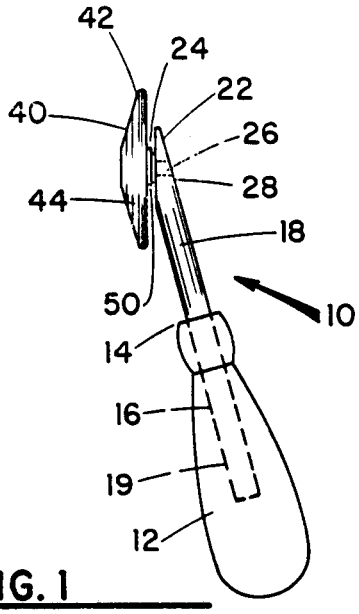
FIG. 1 is a side elevational view of the carpet finishing tool.

Referring to FIG. 1, there is a shown a side elevational view of the carpet finishing tool 10. Carpet finishing tool 10 comprises a handle 12 having a cross sectional configuration enabling it to be gripped comfortably with one hand. At one transverse end, 14, handle 10 has a longitudinal channel 16 for the receipt of longitudinal support shaft 18. Longitudinal support shaft 18 has a first transverse end 19 which is secured in longitudinal channel 16 and a second transverse end 22. Second transverse end 22 is angularly tapered to present a flat surface 24. Aperture 26 communicates from flat surface 24 to opposite circumferential edge surface 28 of longitudinal support shaft 18 to accommodate a securing means as described hereafter.

A rotatable biased disk 40 having a rounded circumferential edge 42 and a conical surface 44 is mounted to longitudinal support shaft 18 by a securing means 46 passing through a centrally disposed aperture 48 in rotatable biased disk 40. Rotatable biased disk 40 is rotatable about securing means 46 and there is positioned between rotatable biased disk 40 and flat surface 24 of longitudinal support shaft 18, a bearing surface 50.

Figure 2:
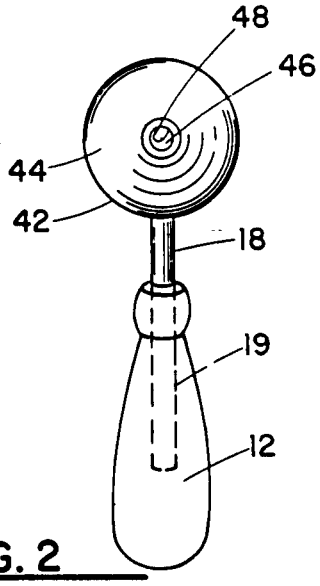
FIG. 2 is a front planer view of the carpet finishing tool.
Figure 3:
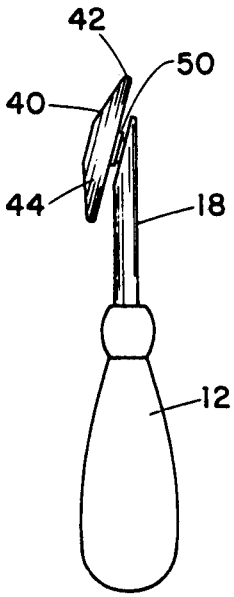
FIG. 3 is a side planer view of the finishing tool.

In this configuration, biased rotatable disk 40 is freely rotatable about securing means 46. In the preferred embodiment, rotatable disk 40 freely rotates about securing means 46 by means of a plurality of ball bearings secured in an annular interior channel of rotatable disk 40 to provide for the free rotation about securing means 46. It should be noted that first transverse end 19 of support shaft 18 may be secured into longitudinal channel 16 by means of a threaded fastener or other suitable securing means. FIGS. 2 and 3 respectively show a front and side planer view of the finishing tool.

In practice, the rounded circumferential edge 42 of biased rotatable disk 40 is utilized to secure carpet in an aesthetically appearing fashion when such carpet is secured by way of a tacking means. Flat surface 44 of rotatable biased disk 40 is designed to secure carpet when said carpet is secured to the floor by means of adhesive. The relative operation of the carpet finishing tool in these two functions is more readily discernible with reference to FIGS. 4 and 5.

Figure 4:
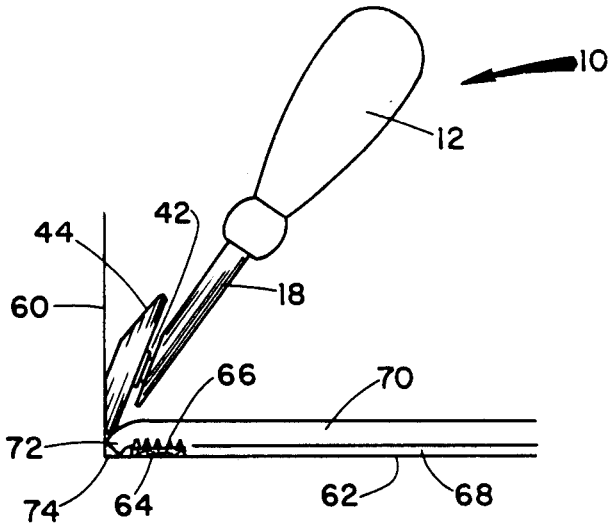
FIG. 4 is a perspective view of the finishing tool securing tacked carpet.

Referring to FIG. 4, there is shown a side elevational view of finishing tool 10 in operation with respect to the installation of tacked carpet. In this configuration, a ninety degree angle is formed by baseboard 60, and floor 62. A tacking strip 64 is positioned by the carpet layer, parallel to the baseboard 60, tacking strip 64 having a plurality of upwardly depending carpet tack 66. Normally, carpet padding 68 is installed over floor 62 with the padding terminating at tacking strip 64. Carpet 70 is cut and laid to the baseboard and stretched by the operator toward the baseboard to prevent wrinkling at the center of the room. The edge 72 of the carpet is tucked between the gap formed by tacking strip 64 and baseboard 60. Finishing tool 10 is then gripped by the operator and positioned such that the rounded circumferential edge 42 of finishing tool 10 is positioned in gap 74 and in contact with carpet edge 72. The conical flat surface 44 of rotatable biased disk 40 is substantially vertically parallel with baseboard 60. In this configuration, the operator stretches the carpet toward the baseboard and gripping finishing tool 10, draws finishing tool 10 along gap 74 to tuck edge 72 of carpet 70 in a secure and aesthetically appearing manner along baseboard 60. Variable pressure by the operator ensures that carpet 70 is secured to tacking strip 64 and the upwardly depending tack 66 so that there is no slipping of the carpet away from baseboard 60.

Figure 5:
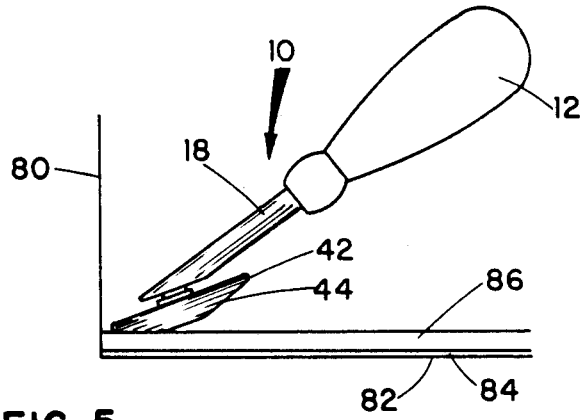
FIG. 5 is a perspective view of the finishing tool securing adhesive carpet.

Referring to FIG. 5, there is a side elevational view of finishing tool 10 used in operation with carpet which is adhesed to the floor. In this configuration, there is baseboard 80 forming a substantial right angle with floor 82. An adhesive 84 is spread upon floor 82 and the carpet is stretched and cut to conform to the configuration of the room and placed over adhesive 84. In this configuration, finishing tool 10 is held by the operator such that circumferential edge 42 is in distal contact with baseboard 80 and that flat conical surface 44 is in contact with the edge of carpet 86 proximate to baseboard 80. Again, the operator would draw the finishing tool 10 along the baseboard 80 with flat conical surface 44 in contact with carpet 86. The operator would induce the appropriate amount of pressure onto finishing tool 10 in drawing it along baseboard 80 such that rotatable biased disk 40 would rotate and press carpet 86 in contact with adhesive 84 to secure carpet 86 in aesthetic contact with adhesive 84 and baseboard 80. The operator could repeat this process as often as required to ensure that carpet 86 is sufficiently adhesed to floor 82.

While the present invention has been described in connection with the exemplary embodiment thereof, it will be understood that many modifications will be apparent to those of ordinary skill in the art and that the application is intended to cover any adaptations or variations thereof. Therefore, it is manifestly intended that this invention be only limited by the claims and the equivalents thereof.

I claim:

1. A carpet finishing tool comprising a handle having a first end and a second end, said first end having a contoured gripping surface, said second end having longitudinally secured thereto a support shaft having a first end secured to said handle and a second end, said second end having a planer surface acutely angled with the axis of said support shaft;

a rotatable disk having a base and a top, truncated in cross sectional area defining a tapered surface from said base to said top, said base having rounded edges;

said rotatable disk mounted on said support shaft such that said base is parallel with said planer acutely angled surface of said support shaft.

2. A carpet finishing tool in accordance with claim 1 wherein said rotatable disk has a tapered surface from said outer diameter of said base to said top.

3. A carpet finishing tool in accordance with claim 1 wherein said rounded edges of said outer diameter of said base provide an engagement means for securing tacked carpeting.

4. A carpet finishing tool in accordance with claim 1 wherein said tapered surface provides an engagement means for securing adhesive carpeting.

5. A carpet finishing tool in accordance with claim 1 wherein said tapered surface is in substantial perpendicular alignment with the baseboard when said rounded edges rotatably engage said tacked carpeting.

6. A carpet finishing tool in accordance with claim 1 wherein said rounded edges are in distal proximate contact with a baseboard when said tapered surface is rotatably engaged with said adhesive carpeting.

* * * * *